United States Patent [19]

Colombani

[11] 4,179,045

[45] Dec. 18, 1979

[54] LIQUID TRANSFERRING DEVICE

[76] Inventor: Piero Colombani, 11, Via Sigieri, Milan, Italy

[21] Appl. No.: 876,292

[22] Filed: Feb. 8, 1978

[30] Foreign Application Priority Data

Feb. 14, 1977 [IT] Italy ..... 20245 A/77

[51] Int. Cl.[2] ..... B22D 41/00; B22D 45/00

[52] U.S. Cl. ..... 222/590; 164/63; 164/253; 222/595

[58] Field of Search ..... 164/61, 63, 133, 253, 164/437; 222/204, 590, 595

[56] References Cited

U.S. PATENT DOCUMENTS

| | | | |
|---|---|---|---|
| 2,893,860 | 7/1959 | Lorenz | 164/61 X |
| 3,558,121 | 1/1971 | Lenne | 164/437 X |
| 3,776,439 | 12/1973 | Settle | 164/437 X |
| 3,834,587 | 9/1974 | Bengt et al. | 222/595 |
| 3,921,859 | 11/1975 | Colombani | 222/204 |

FOREIGN PATENT DOCUMENTS

| | | | |
|---|---|---|---|
| 1001134 | 8/1965 | United Kingdom | 164/63 |

*Primary Examiner*—David A. Scherbel
*Attorney, Agent, or Firm*—Millen & White

[57] ABSTRACT

This invention relates to improvements in a liquid transferring device, in particular for molten metals, of the type comprising an inverted U-shaped siphon connected with a crucible to form a hydraulic circuit having one or more liquid inlet openings and connectable to at least one source of vacuum and at least one source of pneumatic pressure in order to suck the liquid into the crucible and then push the same through the hydraulic circuit and prime the siphon. The improvement comprises a degassing chamber located at the siphon bight and maintained under a pre-established negative pressure during the transferring operation.

11 Claims, 2 Drawing Figures

LIQUID TRANSFERRING DEVICE

BACKGROUND OF THE INVENTION

This invention relates to improvements in and to a liquid transferring device of the type as described and claimed in the U.S. Pat. No. 3,921,859 of the same applicant. The device according to said U.S. patent is particularly adapted for transferring liquids having chemical and/or thermal features of such a nature as to prevent the use of valve means or the like, as in transferring molten metals. Such a device, for transferring liquids contained at a given level in a first container to a second container located at an elevation lower than such given level, comprises, in combination, an inverted U-shaped liquid-transferring siphon pipe, having a rising length and a descending length extending from the bight of its inverted U-shape, positioned while in use with its rising length in said first container and its descending length extending downwardly toward said second container with an outlet end at an elevation below said given level; said rising length communicating with the liquid level in said first container at a liquid inlet opening at a level below said given level; a gas-tightly sealable crucible filling chamber having a bottom inlet in fluid-tight communication with said rising lengths and communicating with said liquid inlet opening; and pneumatic pressure applying means communicating with said crucible filling chamber at its upper end and selectively operable to selectively apply either a negative or a positive pressure controllably to liquid in said siphon pipe to prime said siphon pipe for transfer of liquid from said first container to said second container.

SUMMARY OF THE INVENTION

An object of this invention is to provide an improvement in a device of the type described above, and such that the use thereof gives results which are more reliable, safe and precise.

According to this invention, the liquid transferring device comprises a degassing and priming maintaining chamber formed in and contiguous with the bight of the U-shaped siphon pipe. During the whole transferring operation, this chamber is kept at a small negative pressure differential with respect to the environment by pneumatic pressure applying means communicating with the upper portion of the chamber. The effect of incorporating the improvement of the invention in the aforementioned prior art siphon is to maintain the priming conditions within the siphon pipe by avoiding any bunching within said siphon bight of gas bubbles which are released by the transferred liquid and simultaneously effect a suitable liquid degassing action, in particular when transferring molten materials.

The above and further features of the invention will be now described with reference to the attached drawing and are pointed out in the attached claims.

DESCRIPTION OF A PREFERRED EMBODIMENT

Figure 1:
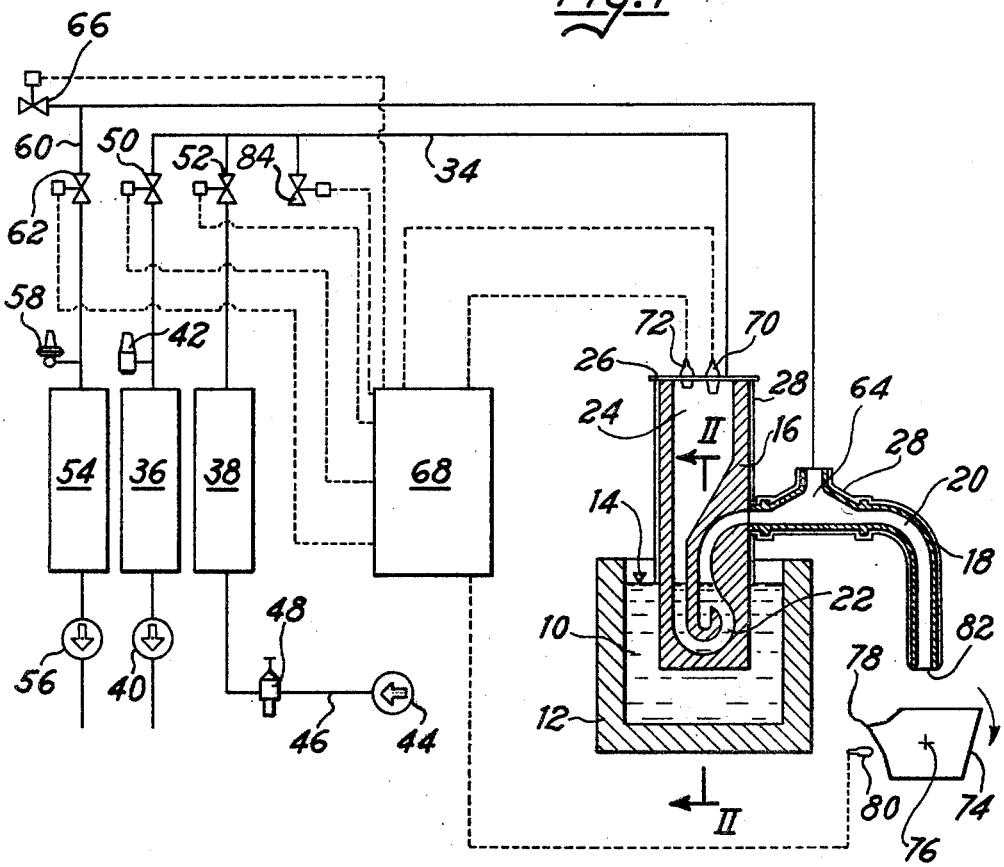
FIG. 1 is a diagrammatic view with parts in section showing a preferred embodiment of a device according to this invention.

With reference to the accompanying drawing, a liquid 10 is to be transferred from a container 12, for example, an aluminum furnace pocket, wherein the liquid is at a level 14, to a second container at a lower level. The exemplified device comprises a crucible 16 made of a suitable material, e.g., a refractory material with a high content of alumina, to which an appendix 18 is attached to form a hydraulic circuit having a siphon portion 20 which is connected, by means of a curve-shaped connection 22, with a crucible filling chamber 24 which is a gas-tightly closed by an upper cover 26. The siphon pipe 20 and connection 22 have a substantially constant inner diameter, while the chamber 24 has an enlarged section in a portion thereof lying above the liquid level 14. Said portion of chamber 24 and said appendage 18 carry an outer reinforcing metallic coating 28 to counteract the forces due to the liquid during the priming operation.

Figure 2:
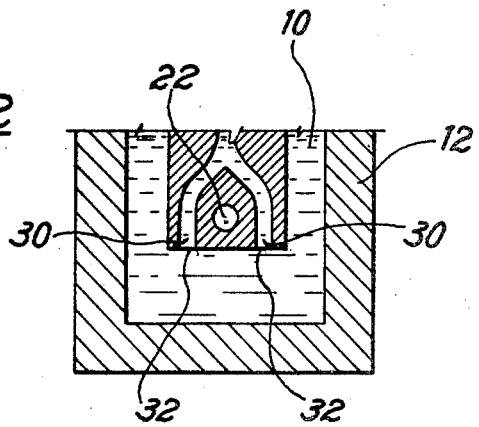
FIG. 2 is a partial cross-section along the plane II—II of FIG. 1.

Substantially in correspondence with the connecting portion between siphon 20 and connection 22, a liquid inlet double pipe 30 opens into said hydraulic circuit, said double pipe having liquid inlet lower openings 32 and a branched shape shown in FIG. 2. The chamber 24 is pneumatically connected, through a duct 34, with two storage units 36 and 38 which are maintained at given levels of vacuum and pressure respectively relative to the environment. In particular, the storage unit 36 is connected with a vacuum pump 40 and a given vacuum degree is maintained therein by means of a pressure regulator 42, while the storage unit 38 is connected with a compressed air source 44 through a duct 46 and a pressure reducing device 48 in order to maintain therein a predetermined pressure degree. The duct 34 may be alternately connected with the storage unit 36 or 38 under the control of two valves 50 and 52. The crucible may also be opened to the atmosphere through duct 34 and valve 84.

A third storage unit 54 is connected with a vacuum pump 56 and a pressure regulator 58 to maintain a given vacuum degree that is less negative than that within storage unit 36. Said storage unit 54 is connected, through a duct 60 and a valve 62, with a little chamber 64 formed in the siphon bight portion. Said chamber 64 may be connected with the atmosphere by means of a valve 66. An electric panel 68 controls said pneumatic circuit by means of electric connections with the valves, as shown by dotted lines in the drawing.

In order to carry out the liquid transferring operation, the crucible 16 is immersed into the container 12 and, when a molten metal is handled, a given time is left to said crucible to reach an operational temperature. During this time, valve 84 is open. Following this, the operator closes valve 84 and actuates a "pumping" push button to connect the crucible filling chamber 24 with storage unit 36 through valve 50, in order to form a given vacuum within said chamber 24, which is sufficient to cause the liquid to enter through openings 32 into the hydraulic circuit and substantially fill chamber 24. When the sucked liquid level has reached a switching electrode 70 on cover 26, said electrode 70 controls a closure of valve 50 and an opening of valve 52, so that chamber 24 is connected with the pressure air source 38 and a time pressure pulse pushes the liquid within the hydraulic circuit 24, 22, 20 to prime the siphon.

Due to fluidodynamic resistances of the hydraulic circuit and of the double inlet conduit 30, the pressure pulse pushes the liquid in the siphon priming direction instead of toward the container 12 through conduit 30. When the siphon is primed the valve 52 is closed and valve 62 is opened to connect the storage unit 54 with the chamber 64, in order to keep within chamber 64 a vacuum degree sufficient to maintain the siphon priming condition and to avoid any bulging of gases which may be dissolved in the liquid and released therefrom at the siphon bight. This results in an advantageous metal degassing which results in better metal quality.

A safety electrode 72 ensures that the sucking action in crucible filling chamber is interrupted before the liquid level attains the cover 26.

To interrupt the transferring operation, the chamber 64 is connected to the atmosphere through the valve 66.

The exemplified device may be used as a batching device in order to batch the transferred liquid, in particular for medium and large batches, by associating the same with means adapted to meter the transferred liquid and to stop the transferring operation when a required transferred volume or weight is attained. The above means may detect for instance the weight of a container wherein the liquid is transferred and break the fluid stream within the siphon when a given weight value is attained. According to another embodiment, in particular for die-casting machines requiring a high precision, the container 74, wherein the molten metal is transferred, may be swingingly mounted on a horizontal axis 76 and is so sized to exactly hold the required liquid amount. Said container 74 comprises an overflow duct 78 through which the liquid in excess is poured on an electrode pair 80 or other device to interrupt the transferring operation. It is then sufficient to wait until the liquid excess is completely drained through the overflow duct 78 to exactly batch the transferred liquid and then feed said batch, for example, by tilting the container 74, to a die-casting machine or the like.

It is also possible to employ a movable support for the crucible 16 in order to maintain the liquid head between level 14 and siphon outlet opening 82 at a constant value during the transferring operation. In such a manner a constant liquid transferring flow rate is obtained, said flow rate being a function of the hydraulic circuit geometry and of said head.

It is to be understood that the exemplified device may be modified, in particular according to the features of the liquid to be transferred, without departing from the scope of the invention.

I claim:

1. In a liquid transfer device suitable for transferring high temperature liquids, contained at a given level in a first container, to a second container located at an elevation lower than said given level, said device comprising an inverted generally U-shaped siphon having a rising leg, a bight and a descending leg, and communicating with a gas-tightly sealable crucible filling chamber to form a hydraulic circuit having at least one liquid inlet port; wherein communication may be selectively effected between the crucible filling chamber and (1) a first vacuum means to withdraw liquid into the crucible filling chamber or (2) pressure means to push the liquid through the hydraulic circuit to prime the siphon, the improvement which comprises:

a prime-maintaining and degassing chamber formed in the bight of the inverted generally U-shaped siphon; and second vacuum means communicating with the degassing chamber and selectively operable to apply a negative pressure to the degassing chamber throughout the transfer operation sufficient to maintain the prime and to degas the liquid in the siphon pipe.

2. The liquid transfer device of claim 1, which further comprises a first valve means communicating with the degassing chamber and with the atmosphere and selectively operable to effect communication between the degassing chamber and the atmosphere so as to interrupt the liquid transfer operation.

3. The liquid transfer device of claim 2, in combination with means for stopping the transferring operation when a pre-set volume of transferred metal is reached within an exactly sized container having an overflow duct, wherein said stopping means are means for detecting liquid falling from the overflow duct of the exactly sized container and stopping the transfer operation as soon as said falling liquid is detected.

4. The liquid transfer device of claim 3, wherein said exactly sized container is oscillably mounted for transferring liquid to a user.

5. The liquid transfer device of claim 2 which further comprises:

first duct means communicating with the first vacuum means, the pressure means and the upper end of the crucible filling chamber;

second valve means selectively operable to effect communication between the first vacuum means and the first duct means, wherein the first vacuum means includes a first storage unit communicating with a first vacuum pump through a first pressure regulator;

third valve means selectively operable to effect communication between the pressure means and the first duct means, wherein the pressure means includes a second storage unit communicating with a compressed air source through a second pressure regulator;

fourth valve means communicating with the first duct means and the atmosphere and selectively operable to effect communication between the first duct means, the crucible filling chamber and the atmosphere;

second duct means communicating with the degassing chamber and the second vacuum means, wherein the second vacuum means includes a third storage unit communicating with a second vacuum pump through a third pressure regulator; and fifth valve means selectively operable to effect communication between the second vacuum means and the second duct means; and a liquid level detector in the crucible filling chamber adjacent its upper end, operable responsive to liquid in said crucible vessel attaining a predetermined level therein near to its upper end to operate the second valve means to disconnect the first vacuum means from the first duct means and to operate the third valve means to selectively apply a positive pressure to liquid in the siphon pipe;

wherein a negative pressure is maintained in the third storage unit sufficient to maintain the prime and degas the liquid in the degassing chamber; a negative pressure is maintained in the first storage unit; and a positive pressure is maintained in the second storage unit; the negative pressure in the third storage unit having a smaller absolute value than that in the first storage unit.

6. The liquid transfer device of claim 1, wherein said at least one liquid inlet port comprises an inverted generally Y-shaped branched inlet pipe having an inlet port at the terminus of each branch, the upper stem of which is a downward extension of the rising leg of the inverted generally U-shaped siphon, said rising leg communicating through a curved section with the lower end of the crucible filling chamber to complete the hydraulic circuit.

7. The liquid transfer device of claim 1, wherein said bight has a substantially straight horizontal portion in which said degassing chamber is formed.

8. The liquid transfer device of claim 1, wherein said first vacuum means is independent and distinct from said second vacuum means.

9. The liquid transfer device of claim 8, wherein the negative pressure applied by said second vacuum means has a lower absolute value than the negative pressure applied by said independent and distinct first vacuum means.

10. In a liquid transfer device suitable for transferring high temprature liquids, contained at a given level in a first container, to a second container located at an elevation lower than said given level, said device comprising an inverted generally U-shaped siphon having a rising leg, a bight and a descending leg and communicating with a gas-tightly sealable crucible filling chamber to form a hydraulic circuit having at least one liquid inlet port; wherein communication may be selectively effected between the crucible filling chamber and (1) a first means to withdraw liquid into the crucible filling chamber or (2) pressure means to push the liquid through the hydraulic circuit to prime the siphon, the improvement wherein:

said at least one liquid inlet port comprises an inverted generally Y-shaped branched inlet pipe having an inlet port at the terminus of each branch, the upper stem of which is a downward extension of the rising leg of the inverted generally U-shaped siphon, said rising leg communicating through a curved section with the lower end of the crucible filling chamber to complete the hydraulic circuit.

11. In a method for transferring molten metal, contained at a given level in a first container, to a second container located at an elevation lower than said given level, said method comprising the steps of withdrawing molten metal from the first container upwardly into a crucible filling chamber having a lower port communicating with a tube immersed in the container of molten metal, by applying a vacuum to the crucible filling chamber;

pushing the molten metal from the crucible filling chamber through a connecting tube into the rising leg, the bight and the descending leg of an inverted generally U-shaped siphon having a rising leg, a bight and a descending leg, and having an inlet port communicating with the rising leg of the siphon and immersed in the container of metal, by applying a timed pressure pulse to the crucible filling chamber, thereby priming the siphon and initiating the transfer operation; the improvement which comprises:

applying a negative pressure to the molten metal in the bight portion of the siphon, said negative pressure being applied after priming and maintained throughout the transfer operation; wherein said negative pressure is sufficient to maintain the prime and degas the metal passing through the siphon bight, and is lower in absolute value than the vacuum applied to withdraw molten metal into the crucible filling chamber.

* * * * *